United States Patent [19]

Coombs

[11] Patent Number: 5,066,984

[45] Date of Patent: Nov. 19, 1991

[54] DECURLER

[75] Inventor: Peter M. Coombs, Tustin, Calif.

[73] Assignee: Gradco Systems, Inc., Irvine, Calif.

[21] Appl. No.: 122,145

[22] Filed: Nov. 17, 1987

[51] Int. Cl.[5] ..... G03G 15/00

[52] U.S. Cl. ..... 355/309; 355/282; 162/171

[58] Field of Search ..... 355/3 SH, 3 FU, 3 R, 355/14 SH; 219/216; 271/161, 188, 209; 162/271

[56] References Cited

U.S. PATENT DOCUMENTS

| | | | |
|---|---|---|---|
| 4,326,915 | 4/1982 | Mutschler | 162/271 |
| 4,475,896 | 10/1984 | Bains | 162/271 X |
| 4,505,695 | 3/1985 | Billings | 162/271 X |
| 4,571,054 | 2/1986 | Bowler | 355/3 FU |
| 4,591,259 | 5/1986 | Kuo et al. | 355/3 FU |
| 4,627,718 | 12/1986 | Wyer | 355/14 SH |
| 4,632,533 | 12/1986 | Young | 355/3 FU |
| 4,639,405 | 1/1987 | Franke | 355/3 FU |

FOREIGN PATENT DOCUMENTS 61-60554 3/1986 Japan .

*Primary Examiner*—R. L. Moses

*Attorney, Agent, or Firm*—Newton H. Lee, Jr

[57] ABSTRACT

A device is disposed in the path of paper sheets leaving a printing unit or processor such as an office copier or non-impact printer and has an arcuate concave guide and a roll spaced from the guide to form a sheet path which is curved or arched oppositely to the direction in which the sheet is curled in the processor. The space between the guide and the roller is greater than the thickness of the paper and the paper is bent in the direction opposite to its curl as it passes through the arched space, while the beam strength of the paper and the change in direction of the paper maintain adequate drive friction on the sheet. A selector isolates the decurler when it is not needed.

2 Claims, 4 Drawing Sheets

DECURLER

BACKGROUND OF THE INVENTION

One of the factors or problems encountered in electrostatic printing or xerography in office copiers and printers in which the image is fused on the paper under heat and pressure is that the process tends to cause a curl to be formed in the paper. Curled paper is difficult to handle in a receiver for the sheets. Ideally the sets should be neat with edges aligned and easy to handle by an operator or in finishing apparatus in which the set may be stitched or stapled.

The curl problems with sheets of paper stem from the treatment of the sheets in the processor. A sheet of normal paper is taken from a supply cassette or feeder, in an environment in which the paper is subject to humidity and absorbs a certain amount of moisture. The sheet is processed past a photo conductor where powder or liquid ink is applied to produce an image, and then the sheet is passed through a fuser and subjected to heat and pressure between rollers, with the result that normal, flat sheets are caused to curl. Curled sheets received in a collator or sorter in bins cause failure of the device due to jamming or mis-sorting of sheets and the bin capacity of the receiver is reduced. In addition, curled sheets do not tend to form neat stacks or sets.

In efforts to minimize curl problems in copiers and printers, the feed rolls may be modified or bins made larger, but there has been prior to the present invention, no way to remove the curl from paper sheets by returning it to its original, normal flat condition, without requiring the use of complex positively driven rolls with large power consumption and tracking or sheet receiving problems resulting from the use of pressure plates and the like, wrinkling of sheets or smearing of print.

SUMMARY OF THE INVENTION

The present invention provides a de-curler useful between the fusing station of a electrostatic printing machine, such as an office copier or printer, facsimile machine or the like, and the receiver for printed sheets. The device flattens the curl due to movement of the sheet through a gap between an arched plate and a driven roller without applying positive compressive pressure to the sheet between the plate and the roller. More particularly, the arched guide and opposing, spaced roller are placed in the sheet path between the point where the sheet leaves the fusing station in the processor and the point at which the sheet is deposited in the receiver. The plate and roller form a guide with a gap on a reverse curve, compared to the curl in the sheet, the gap being thicker than the paper so that no positive compressive pressure is applied to the sheet.

The advantages include a reduction in moving parts, reduced tendency to wrinkle the sheet or smear printing due to high friction forces, reduced power requirements, and a small compact structure, capable of decurling sheets moving at high feed rates.

In a preferred form, the de-curler includes a gate which can be opened to permit a flat sheet to be fed through the device without passage through the decurling gaps thereby isolating the de-curler.

The invention has other features and advantages which may be more apparent from an understanding of an embodiment thereof illustrated in the accompanying drawings and described in the following detailed description.

DESCRIPTION OF THE PREFERRED EMBODIMENT

Figure 1:
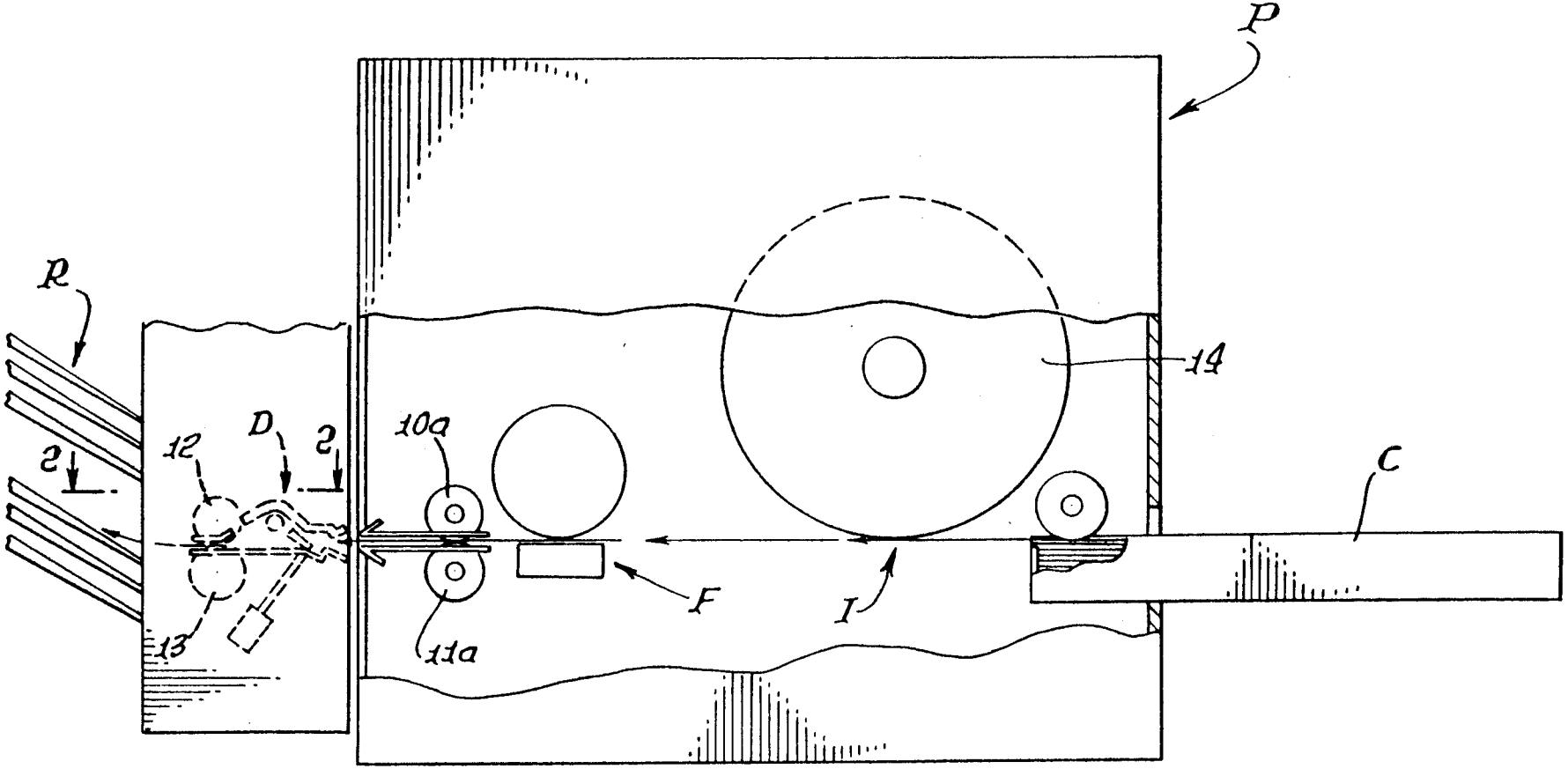
FIG. 1 is a side elevation showing a copier having a sorter and to which the invention is applied.
Figure 2:
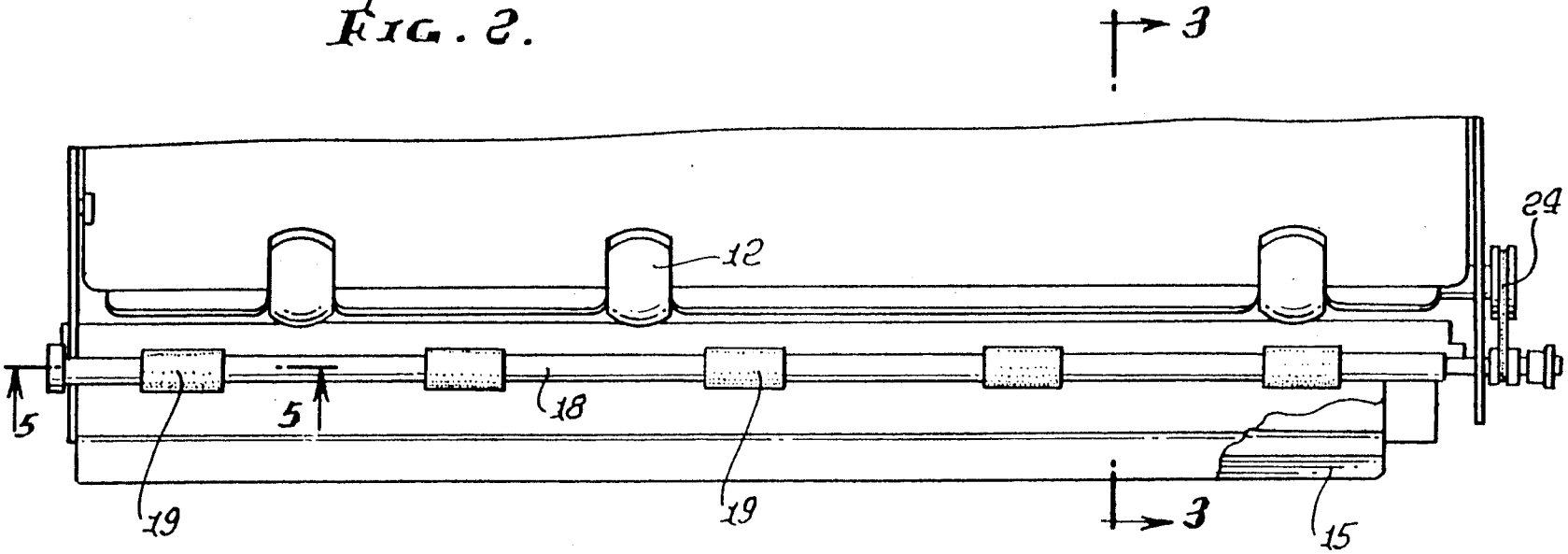
FIG. 2 is a horizontal section on the line 2—2 of 1.

As seen in the drawings a processor P which may be a xerographic copier, a non-impact printer or other processor transfers images at an imaging station I to sheets of paper supplied from a cassette or other feeder C, the sheets then passing to a fusing station F at which the image is fused on the paper under heat and pressure.

Printed sheets then are transferred by exit rolls 10*a* and 11*a*, pass through a de-curler D in accordance with the invention, and are transported by feed rolls 12 and 13 to a suitable receiver R, which may be a single tray, a stacker for printed sets, or a collator for printed sheets. The details of the processor P and the receiver R are not germane to the present invention, except to note that, as well known in the area of xerography or electrophotography printers, sheets fed from the cassette or feeder C pass through the imaging station I at which ink is deposited on the sheet at the large drum 14 and the sheet then moves to the fusing station F and is transported in the left-hand direction, as viewed in FIG. 1, through de-curler D to the rolls 12 and 13 which as shown are input feed rolls for transporting the printed sheets to the receiver R shown as a sorter having trays adapted to receive sets of sheets.

The de-curler D is interposed, in the illustrative embodiment, between the sets of rollers 10*a*, 11*a*, and 12.13 whereby sheets are fed to the de-curler and from the de-curler to the receiver. The de-curler will be seen to be a very simple device, consisting of very few components, namely, a fixed guide 15 formed with a concave arc at 16 and suitably fixed in the frame structure 17, a rotary shaft 18 which extends horizontally and has soft rubber or rubber like rollers 19 thereon formed with a diameter complementing the radius of the arc 16 in guide 15. Bearings 20 for the shaft 18 are mounted on the frame structure and suitably secured in place. A belt drive 22, powered by a motor (not shown) drives shaft 18 and also drives the feed rolls 12 through an O-ring 24 to transport sheets from the de-curler to the receiver.

Figure 4:
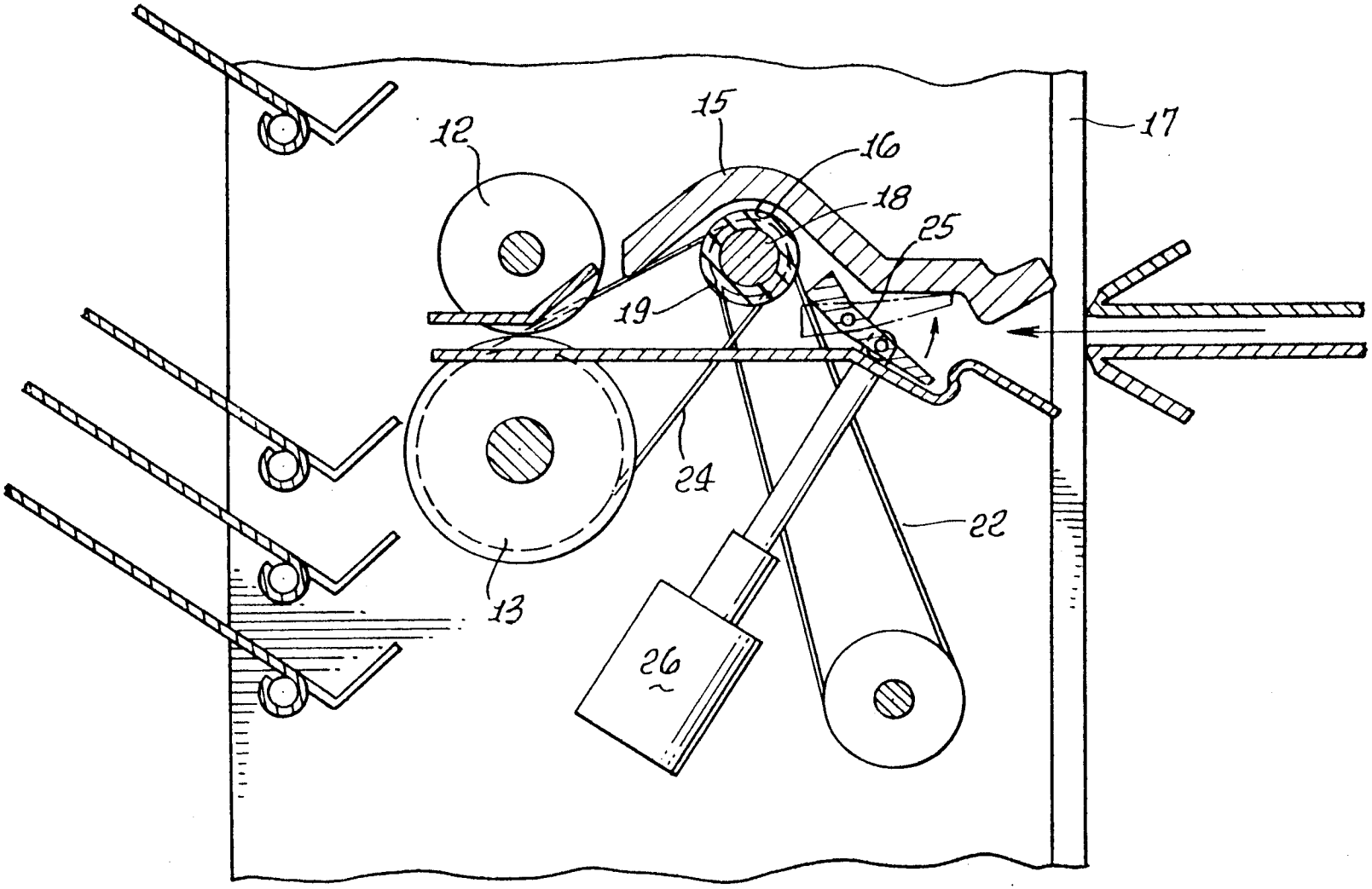
FIG. 4 is an enlarged detail view in vertical section illustrating of the operation of the de-curler.

In the form shown, the de-curler also includes a gate 25 pivotal to the full line position of FIG. 4 by a solenoid 26 to the broken line position and returnable to the broken line position by a suitable return spring. In the full line position of the gate, each sheet fed through the device is deflected to pass between guide 15 and rollers 19, while in the broken line position of the gate the sheets are allowed to pass straight through from rolls 10 and 11 to rolls 12 and 13. This gate feature is of advantage when thick cardboard-like sheets are being processed, or wherein the sheets have not been curled at the fuser F. In the full line gate position, it is effectively a portion of a mouth for the de-curler into which leading edges of sheets pass and are deflected towards the arched section 16 of the guide 15.

Figure 5:
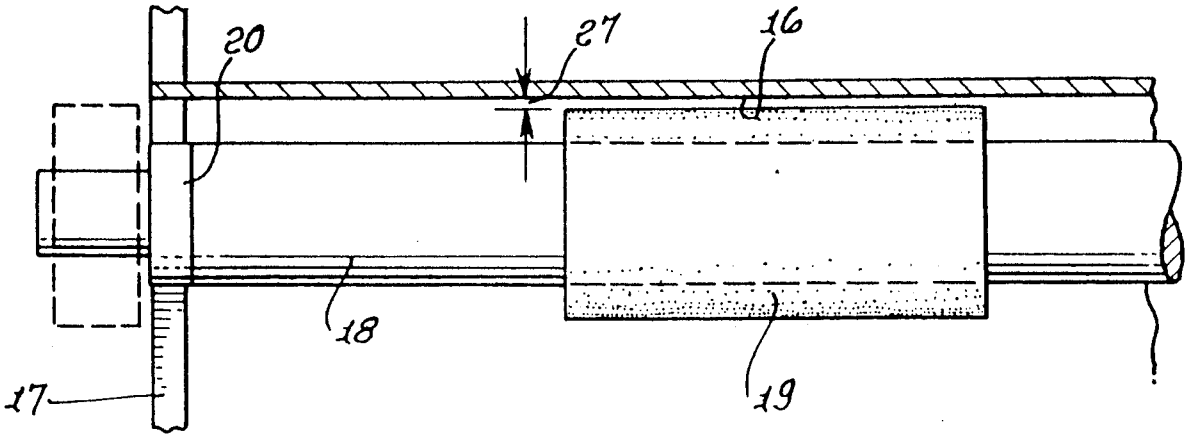
FIG. 5 is an enlarged fragmentary section on line 5—5 of FIG. 1. showing details of the de-curler.
Figure 3:
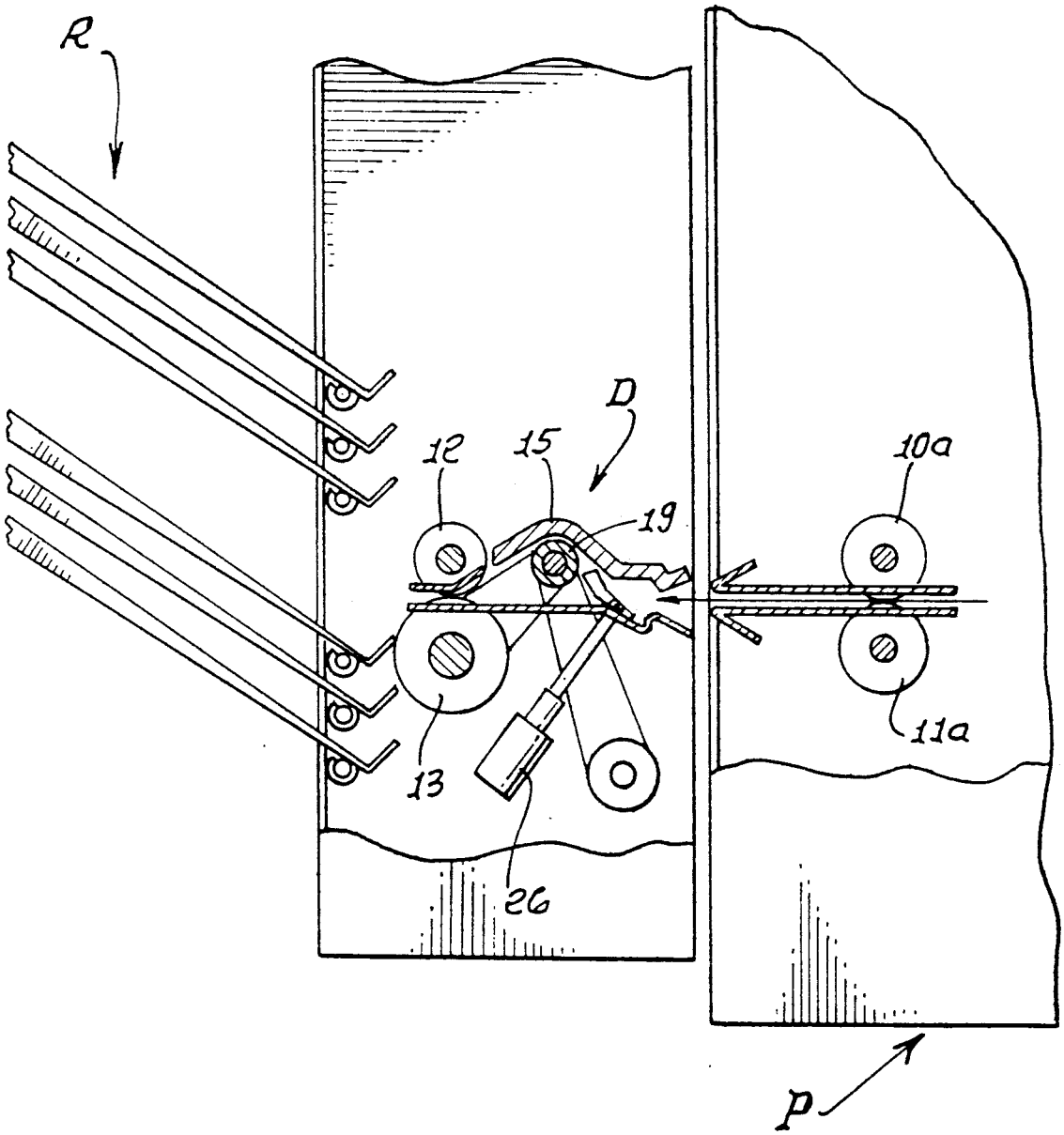
FIG. 3 is a vertical section on the line 3—3 of FIG. 2.

As seen in FIGS. 4 and 5 the bearings 20 for the shaft 18 are positioned with respect to the arched guide section 16 so that there is an arcuate gap 27 which is wider radially than the thickness of a sheet of paper, so that sheets pass through the gap without applied compressive force. The arcuate gap 27 is arched oppositely to the curl in the sheet, so that as the sheet passes through the gap, the curl is bent in the opposite direction.

The coefficient of friction between the driven rollers 19 and the paper sheets and the beam strength of the paper as it is forced to bend in the arched section 16 of the guide maintains adequate frictional drive for the paper, after its trailing edge leaves the positively driven rolls 10*a* and 11*a*, in the case that the paper path from the rollers 10*a* and 11*a* through the de-curler and to the driven rolls 12 and 13 exceeds the length of the sheet.

From the foregoing, it will now be apparent that the invention provides a structurally simple device to decurl sheets wherein the essence of the novelty resides in the fact that the de-curling of sheets in the arcuate gap between arched guide 16 and the complementally arched surfaces of the rolls 19 bend the curled sheets without application of compressive force. During this de-curling operation, due to the lapse of time in transit through the de-curler, the sheet becomes more uniformly dry and has less tendency to re-curl.

The best results have been obtained with my invention when used in conjunction with 16–24 pound copy paper with a moisture content on the order of 8–9% when the gap 27 was on the order of "0.025 or less the rolls radius is on the order of 0.225" and the radius of the curvature 16 on the order of "0.250".

I claim:

1. A device for removing curl from sheets of paper exiting a printing machine comprising: means for decurling sheets including a rotary driven sheets of feed shaft having a paper drive roll thereon and an arched guide member extending partially about said drive roll in closely spaced relation to the outer periphery of said drive roll and forming an arcuate gap exceeding the thickness of the sheets of to longitudinally deform the sheet between said roll and said guide and causing drive friction between said roll and the sheets of, and means for rotating said shaft.

2. The method of decurling sheets of paper exiting from a printing machine or the like comprising the steps of:

decurling the sheet in an arcuate gap defined between opposed arcuate surfaces on a sheet guide and a rotary paper feed roll and deforming the sheet between said guide and said roll in said gap while moving the sheet through said gap by longitudinally deforming the sheet and inducing drive friction between said roll and the sheet.

* * * * *